US008696064B2

(12) United States Patent
Pan

(10) Patent No.: US 8,696,064 B2
(45) Date of Patent: Apr. 15, 2014

(54) BACKREST INCLINATION STRUCTURE FOR LUMBAR SUPPORT

(75) Inventor: Tung-Chun Pan, Tainan (TW)

(73) Assignee: Oasyschair Co., Ltd., Tainan (TW)

( * ) Notice: Subject to any disclaimer, the term of this patent is extended or adjusted under 35 U.S.C. 154(b) by 216 days.

(21) Appl. No.: 13/415,933

(22) Filed: Mar. 9, 2012

(65) Prior Publication Data

US 2013/0234484 A1 Sep. 12, 2013

(51) Int. Cl.
*A47C 7/40* (2006.01)
*A47C 1/024* (2006.01)

(52) U.S. Cl.
USPC ..... 297/301.3; 297/284.4; 297/285

(58) Field of Classification Search
CPC .... A47C 1/024; A47C 1/026; A47C 1/03255; A47C 7/44; A47C 7/443
USPC ..... 297/284.4, 285, 292, 301.3, 301.5, 297/301.6, 301.7, 354.11
See application file for complete search history.

(56) References Cited

U.S. PATENT DOCUMENTS

| | | | | |
|---|---|---|---|---|
| 2,524,624 | A * | 10/1950 | Cramer | 297/291 |
| 6,116,687 | A * | 9/2000 | Vogtherr | 297/300.1 |
| 6,193,314 | B1 * | 2/2001 | Chiang | 297/301.7 |
| 7,347,496 | B1 * | 3/2008 | Wang | 297/383 |
| 7,802,847 | B2 | 9/2010 | Chou | |
| 2006/0202536 | A1 * | 9/2006 | Luchetti et al. | 297/354.11 |
| 2007/0001497 | A1 * | 1/2007 | Diffrient | 297/321 |
| 2010/0148556 | A1 * | 6/2010 | Chou | 297/354.11 |

* cited by examiner

*Primary Examiner* — Philip Gabler
(74) *Attorney, Agent, or Firm* — Alan Kamrath; Kamrath IP Lawfirm P.A.

(57) ABSTRACT

A backrest inclination structure for lumbar support enables a backrest to enter a free state when a user sitting at any position of a chair lifts a lever of a spring continuous control unit, such that the backrest fits the user's moving back when the backrest is configured for movable inclination. Hence, the backrest can move together with the user's back ergonomically to provide lumbar support. Accordingly, the user can sit comfortably on the chair and be free from lumbago and kyphosis which are common among sedentary individuals.

3 Claims, 6 Drawing Sheets

BACKREST INCLINATION STRUCTURE FOR LUMBAR SUPPORT

BACKGROUND OF THE INVENTION

1. Technical Field

The present invention relates to backrest inclination structures for lumbar support and, more particularly, to a backrest inclination structure providing lumbar support and operating in conjunction with a backrest adjustment mechanism positioned at a chair laterally. When in use, the backrest inclination structure can be operated easily to adjust a backrest of the chair and can attain the most comfortable position of the backrest by pressing the human back against the backrest under the weight of the human back. Furthermore, the backrest inclination structure not only enables the human back to conic into tight contact with the adjusted backrest, but also enables the backrest adjustment mechanism to be fixed in place again, thereby simplifying the backrest adjustment assembly and enhancing the comfort provided by the backrest.

2. Description of Related Art

To enable existing chairs to provide maximum comfort to sitters, related manufacturers usually consider equipping a chair with a motion adjustment mechanism whereby a cushion unit, a backrest unit, and an armrest unit of the chair can undergo directional adjustment as needed, to enhance the flexibility of use of the chair.

An angle-adjusting structure for a backrest of a chair disclosed in U.S. Pat. No. 7,802,847 is implemented in the form of an angle-adjusting structure mounted at a rear side of a butterfly-shaped mounting member of the chair. The angle-adjusting structure includes a shaft having external teeth and passing through internal holes of a main body and a rotating member. A resilient element mounted around an end of the shaft, A cover is secured to the main body by a threaded fastener. A pressing member is mounted on an opposite end of the shaft adjacent to an outer wall of the main body. Thus, by pressing the pressing member inward, the external teeth of the shaft are disengaged from the internal teeth of the rotating member, allowing the rotating member to enter a free state for adjusting to any angle. When the pressing member is released, the resilient element mounted around the end of the shaft extends outward to re-engage the external teeth of the shaft with the internal teeth of the rotating member, thereby securing the rotating member in place.

Although the aforesaid angle-adjusting structure for the backrest of the chair allows the backrest of a chair to undergo anticipated angle adjustment when in use, only a portion of the backrest can be in contact with the human back while the adjustment of the inclination of the backrest is taking place, not to mention that the angle-adjusting structure for the backrest of the chair comprises many constituent components which complicate an assembly process and thus incur high costs in the manufacturing process of the chair.

SUMMARY OF THE INVENTION

A conventional backrest adjustment unit positioned at a chair laterally consists of too many constituent elements and thus renders an assembly process thereof complicated, not to mention that only a portion of a backrest of the chair is in contact with the back of a person sitting on the chair, thanks to the conventional backrest adjustment unit. The present invention overcomes the aforesaid drawbacks of the prior art. According to the present invention, a backrest adjustment mechanism positioned at a chair laterally comprises a spring continuous control unit for limiting the position of a support plate pivotally coupled to a backrest from the rear to enable a sitter on the chair to lift the spring continuous control unit by hand to allow the spring continuous control unit to unlock and enter a free state. Thus, the backrest pivotally coupled to the support plate can be adjusted to a preset position and direction when the backrest comes into contact with the human back and under the weight thereof. After a required back contact position has been attained, the sitter presses the spring continuous control unit by hand to allow the spring continuous control unit to return to a locked state and then position precisely the backrest pivotally coupled to the support plate. Thus, the human back can come into tight contact with the adjusted backrest. Hence, the backrest adjustment mechanism is effectively simplified and thus enhances the comfort given to the sitter.

The primary objective of the present invention is to provide a backrest inclination structure for lumbar support, comprising: a backrest adjustment mechanism positioned at a chair laterally; and a spring continuous control unit disposed at an end of a butterfly-shaped mounting member at a bottom of the chair. The spring continuous control unit guides a link member beside a backrest in performing an unlocking operation or a locking operation. A support-connection portion is formed on a rear side of the spring continuous control unit and is directionally fixed to a lower end of a support plate with a preset width and extension length. Two hollow tubes spaced apart from each other are formed at an upper end of the support plate. A connection tube is formed at a rear side and a mass-center position of the backrest. The two hollow tubes straddle the connection tube horizontally. Two hollow bodies are introduced along the two hollow tubes of the support plate, respectively, and are positioned in the connection tube of the backrest. A shaft penetrates the two hollow bodies and the connection tube of the backrest and directionally screwed to another end of the connection tube of the backrest with a screw nut, such that the backrest is pivotally coupled to the support plate. A torque spring has appropriate resilience and is inserted into inward sides of the hollow bodies of the hollow tubes of the support plate. The torque spring has a pin abutting against the rear side of the backrest and another pin abutting against a rear side of the support plate to abut against the backrest with appropriate resilience.

A sitter on the chair lifts the spring continuous control unit by hand to enable the spring continuous control unit to unlock and enter a free state and thereby enable the backrest adjustment mechanism to drive controllably the backrest to perform directional adjustment. Thus, the backrest pivotally coupled to the support plate undergoes preset directional adjustment as soon as the backrest comes into contact with a human back under a weight thereof. After a required back contact position has been attained, the sitter presses the spring continuous control unit by hand to allow the spring continuous control unit to return to a locked state and then position precisely the backrest pivotally coupled to the support plate. Thus, the human back can come into tight contact with the adjusted backrest. Alternatively, the sitter lifts the spring continuous control unit by hand to enable the spring continuous control unit to enter a free state in a manner that the backrest undergoes seamless displacement along with the human back to give comfort to the sitter and protect the sitter against lumbago and kyphosis which are common among sedentary individuals, not to mention that the backrest adjustment mechanism is effectively simplified and thus cuts chair manufacturing costs.

Another objective of the present invention is to provide a backrest inclination structure for lumbar support, comprising a backrest adjustment mechanism positioned at a chair laterally. The backrest adjustment mechanism is provided with covering plates corresponding in shape thereto and pressing against the support plate coupled to the backrest from the front and rear to cover a bottom and the hollow tubes of the support plate directionally with upper and lower ends of the front and rear covering plates and to fix the front and rear covering plates to preset positions of the support plate with screwing elements such that the support plate pivotally coupled to the backrest has an aesthetic appearance.

Yet another objective of the present invention is to provide a backrest inclination structure for lumbar support, comprising a backrest adjustment mechanism positioned at a chair laterally. The backrest adjustment mechanism is provided with covering plates pressing against the support plate coupled to the backrest from the front and rear. Through holes corresponding in position to the connection tube of the backrest and the two hollow tubes of the support plate are formed in the front covering plate to facilitate adjustment of movement between the support plate and the backrest. A hollowed-out zone is formed at the lower end of the rear covering plate to allow screwing elements to lock together the support plate and the support-connection portion on the rear side of the spring continuous control unit when the lower end of the support plate is covered, or to facilitate subsequent removal of the screwing elements. Protruding portions spaced apart from each other protrude from the bottom of the rear covering plate and insert into apertures of the plate, respectively, as soon as an L-shape plate abuts against the hollowed-out zone, such that the rear covering plate has an aesthetic appearance.

DETAILED DESCRIPTION OF THE EMBODIMENTS OF THE INVENTION

Figure 2:
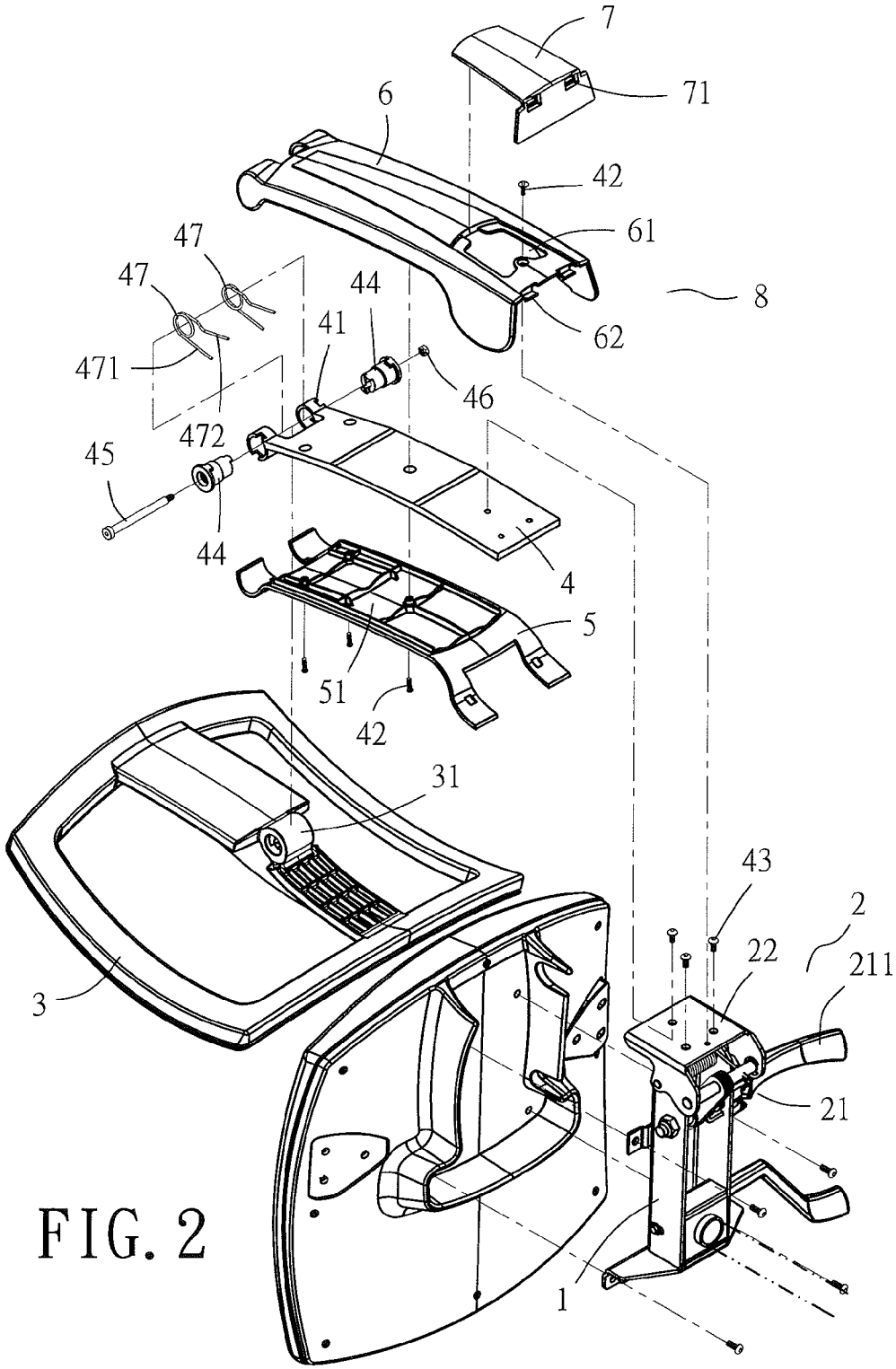
FIG. 2 is an exploded view of a backrest adjustment mechanism integrated with the chair according to the present invention.
Figure 3:
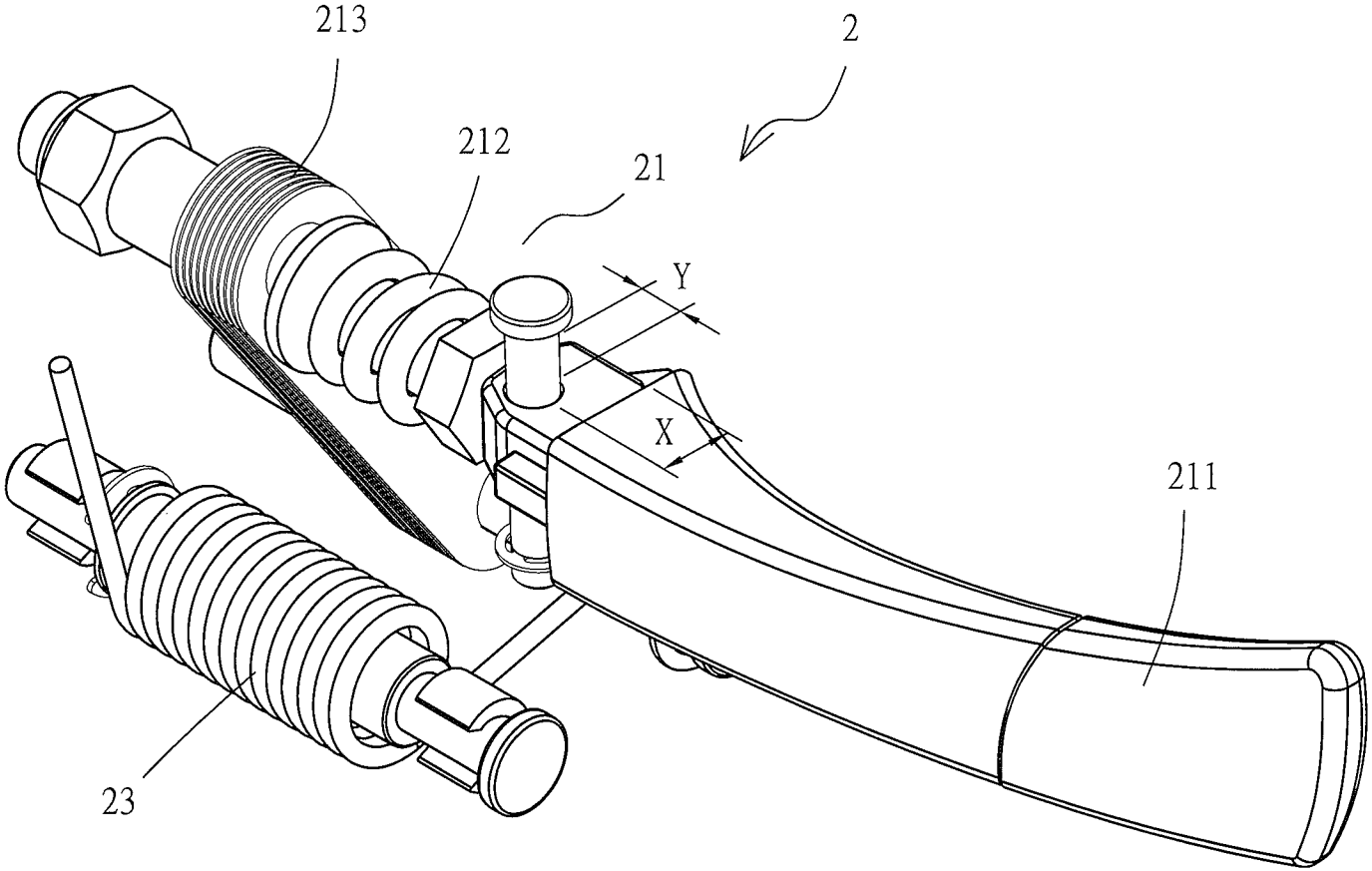
FIG. 3 is a schematic view of backrest adjustment elements disposed at the bottom of the chair according to the present invention.

Referring to FIGS. 2, 3, the present invention provides a backrest inclination structure for lumbar support. As shown in the diagrams, the backrest inclination structure for lumbar support has a backrest adjustment mechanism 8 positioned at a chair 9 laterally. The backrest inclination structure further comprising has a spring continuous control unit 2 disposed at the end of a butterfly-shaped mounting member 1 at the bottom of a chair. The spring continuous control unit 2 comprises a control lever 21 penetrating and straddling the end of the butterfly-shaped mounting member 1, a support-connection portion 22 pivotally coupled to the end of the butterfly-shaped mounting member 1, and a linking spring 23 with one end abutting against the inner side of the support-connection portion 22. Referring to FIG. 2, due to the distance Y shown in FIG. 3, a spring 212 disposed at a lever 211 beside the control lever 21 is prevented from being compressed excessively to stick outward while the lever 211 is lifted. Meanwhile, metal plates 213 at one end of the spring 212 are spaced apart from each other to a greater extent to drive the linking spring 23 in the vicinity thereof to enter a free rotation state. As a result, another pin of the linking spring 23 and the support-connection portion 22 abutting against the end of the butterfly-shaped mounting member 1 are movable relative to each other. Conversely, once the lever 211 at one end of the control lever 21 is pressed downward (i.e., being rotated rightward as shown in FIG. 3), the distance X shown in FIG. 3 causes the spring 212 to be compressed outward. Meanwhile, the metal plates 213 at one end of the spring 212 are compressed to drive the linking spring 23 in the vicinity thereof to enter a locked state. As a result, another pin of the linking spring 23 and the support-connection portion 22 abutting against the end of the butterfly-shaped mounting member 1 are fixed in place relative to each other. A link member (driving a backrest 3 to undergo forward and backward displacement) beside the backrest 3 is guided by the spring continuous control unit 2 to perform an unlocking operation or a locking operation. The advantages of the backrest inclination structure of the present invention are described hereunder.

The support-connection portion 22 formed on the rear side of the spring continuous control unit 2 is directionally fixed to the lower end of a support plate 4 with a preset width and extension length. Two hollow tubes 41 spaced apart from each other are formed at the upper end of the support plate 4. A connection tube 31 is formed at the rear side and a mass-center position of the backrest 3. The two hollow tubes 41 straddle the connection tube 31 horizontally. Before the support plate 4 straddles on the connection tube 31 located at the mass-center position of the backrest 3, the support plate 4 is clamped between front and rear covering plates 5, 6 corresponding in shape thereto from the front and the rear, respectively (as shown in FIG. 2), in the manner that the upper and lower ends of the front and rear covering plates 5, 6 cover the two hollow tubes 41 and the bottom of the support plate 4, respectively. The front and rear covering plates 5, 6 are screwed to preset positions of the support plate 4 and thus are fixed thereto by screwing elements 42, such that the support plate 4 pivotally coupled to the backrest 3 has an aesthetic appearance.

Through holes 51 corresponding in position to the connection tube 31 of the backrest 3 and the two hollow tubes 41 of the support plate 4 are formed in the front covering plate 5 to facilitate adjustment of movement between the support plate 4 and the backrest 3. A hollowed-out zone 61 is formed at the lower end of the rear covering plate 6 to allow screwing elements 43 to lock together the support plate 4 and the support-connection portion 22 on the rear side of the spring continuous control unit 2 when the lower end of the support plate 4 is covered, or to facilitate subsequent removal of the screwing elements 43. Protruding portions 62 spaced apart from each other protrude from the bottom of the rear covering plate 6 and insert into apertures 71 of the plate 7, respectively, as soon as an L-shape plate 7 abuts against the hollowed-out zone 61, such that the rear covering plate 6 has an aesthetic appearance.

Figure 1:
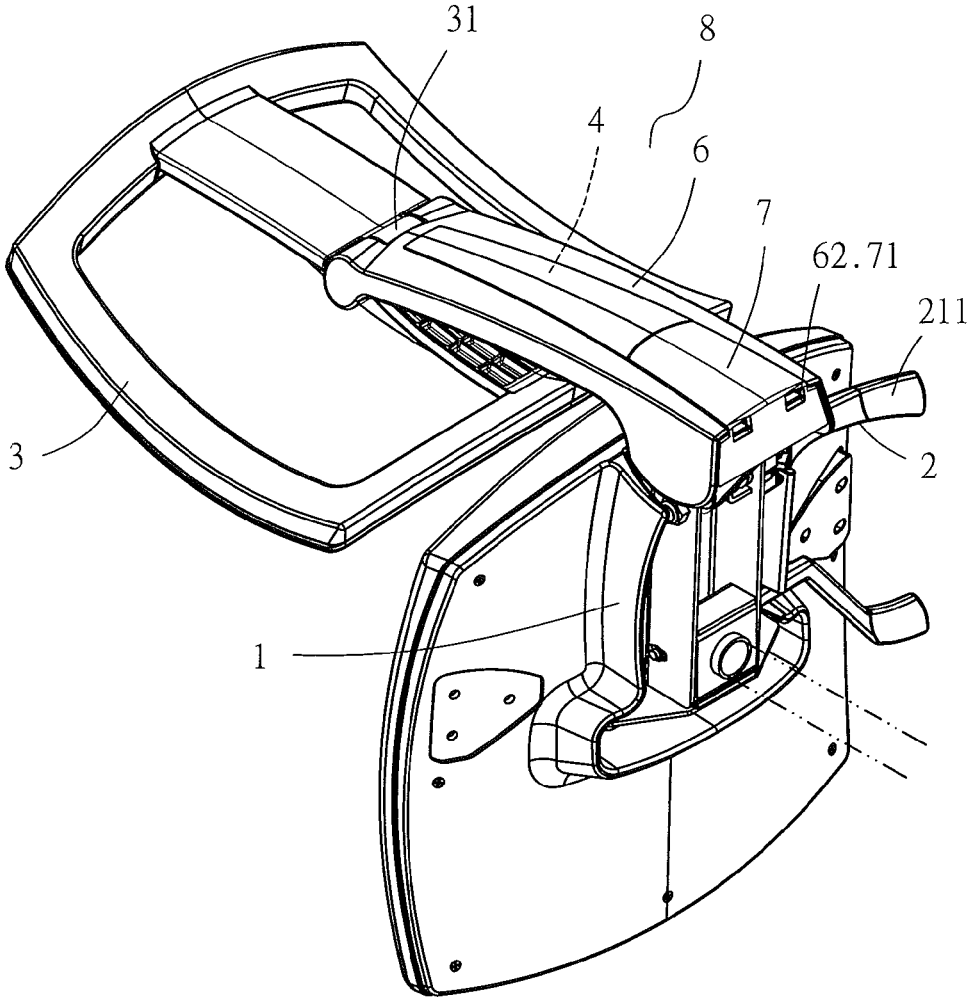
FIG. 1 is a perspective view of a backrest assembly coupled to a chair according to the present invention.
Figure 4:
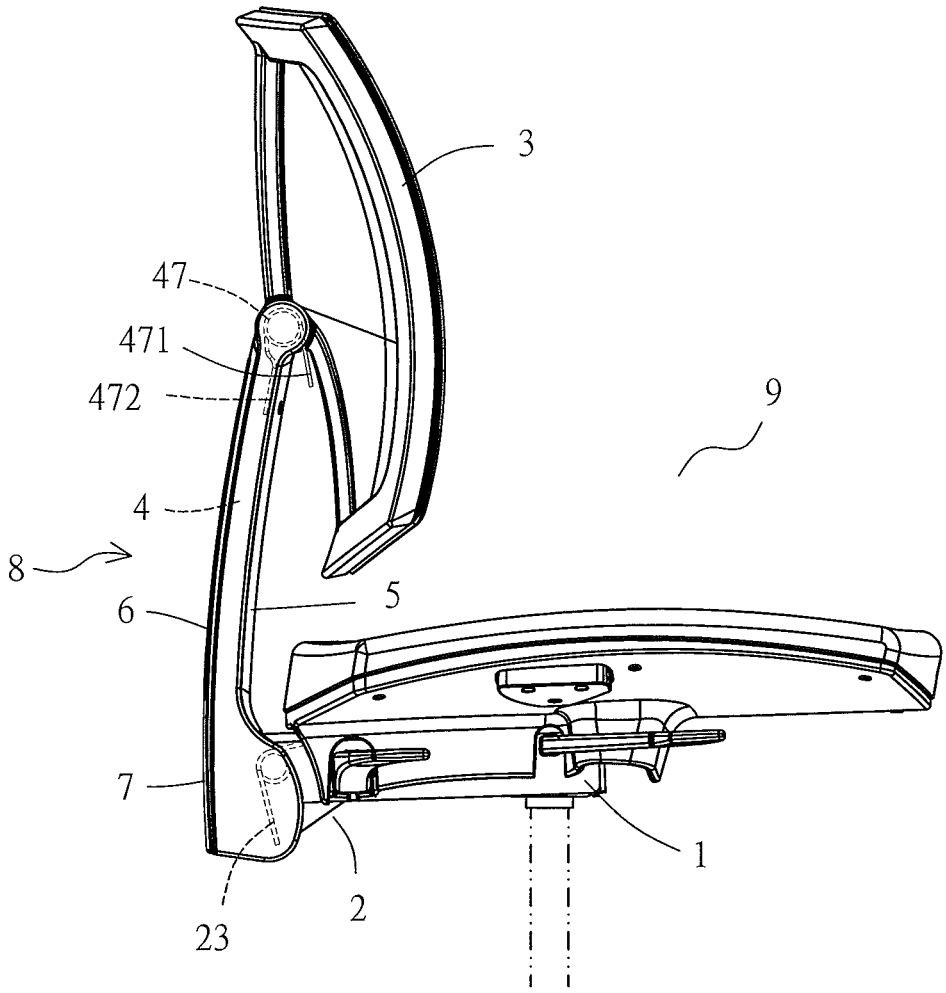
FIG. 4 is a side view of a backrest installed on the chair laterally prior to movement according to the present invention.

After the two hollow tubes 41 formed at the upper end of the support plate 4 have horizontally straddled the connection tube 31 located at the mass-center position of the backrest 3, two hollow bodies 44 are introduced along the hollow tubes 41 of the support plate 4, respectively, and are positioned in the connection tube 31 of the backrest 3. A shaft 45 penetrates the two hollow bodies 44 and the connection tube 31 of the backrest 3 and is directionally screwed to another end of the connection tube 31 of the backrest 3 with a screw nut 46, such that the backrest 3 is pivotally coupled to the support plate 4 (as shown in FIG. 1). A torque spring 47 having appropriate resilience is inserted into inward sides of the hollow bodies 44 of the hollow tubes 41 of the support plate 4. The torque spring 47 has a pin 471 abutting against the rear side of the backrest 3 and another pin 472 abutting against the rear side of the support plate 4 to abut against the backrest 3 with appropriate resilience (as shown in FIG. 4).

Figure 5:
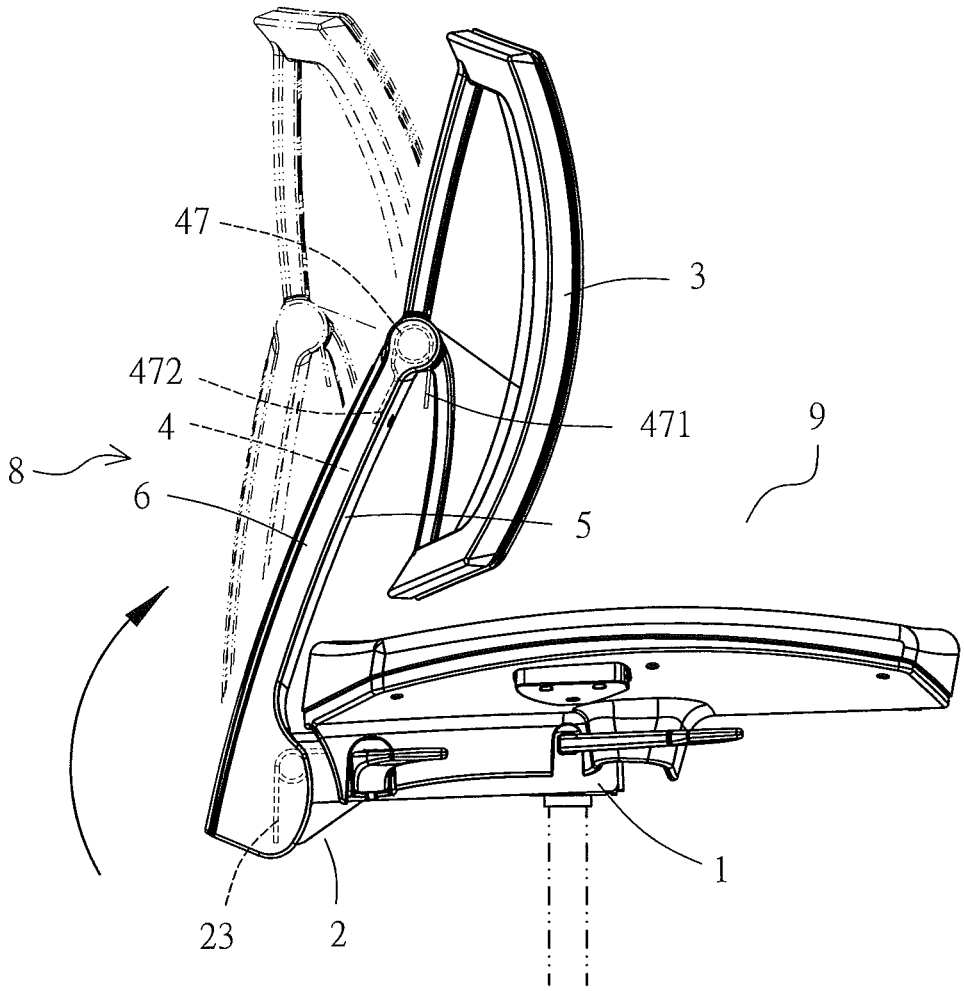
FIG. 5 is a schematic view of the backrest installed on the chair laterally during forward movement according to the present invention.
Figure 6:
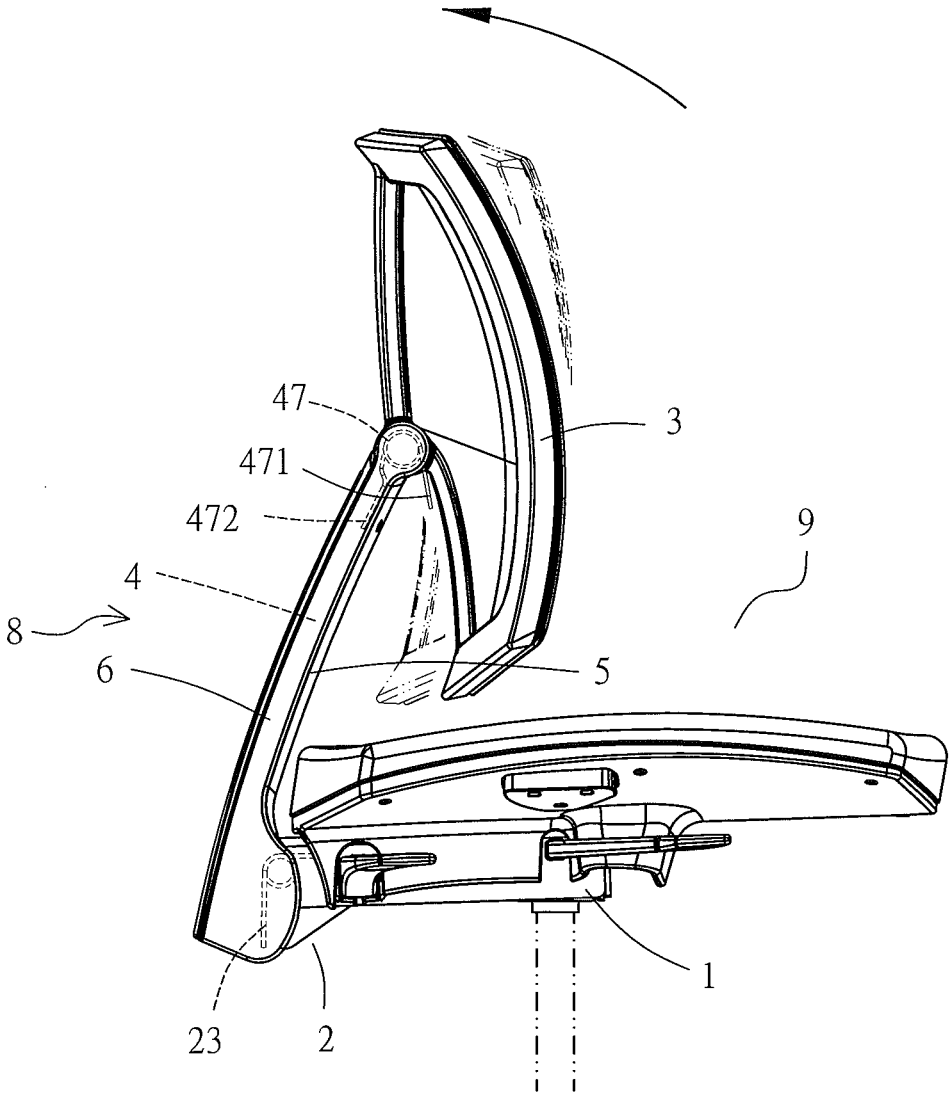
FIG. 6 is a schematic view of the backrest installed on the chair laterally during backward movement according to the present invention.

A sitter on the chair lifts the spring continuous control unit 2 by hand to enable the spring continuous control unit 2 to unlock and enter a free state and thereby enable the backrest adjustment mechanism 8 to drive controllably the backrest 3 to perform directional adjustment. Thus, the backrest 3 pivotally coupled to the support plate 4 undergoes preset directional adjustment as soon as the backrest 3 comes into contact with a human back under a weight thereof (as shown in FIGS. 5, 6). After a required back contact position has been attained, the sitter presses the spring continuous control unit 2 by hand to allow the spring continuous control unit 2 to return to a locked state and then position precisely the backrest 3 pivotally coupled to the support plate 4, such that the human back can come into tight contact with the adjusted backrest 3. Alternatively, the sitter lifts the spring continuous control unit 2 by hand to enable the spring continuous control unit 2 to enter a free state in a manner that the backrest 3 undergoes seamless displacement along with the human back to give comfort to the sitter and to protect the sitter against lumbago and kyphosis which are common among sedentary individuals, not to mention that the backrest adjustment mechanism 8 is effectively simplified and thus cuts chair manufacturing costs.

What is claimed is:

1. A backrest inclination structure for lumbar support, comprising:

a backrest adjustment mechanism positioned at a chair laterally;

a spring continuous control unit disposed at an end of a butterfly-shaped mounting member at a bottom of the chair, wherein the spring continuous control unit guides a link member beside a backrest in performing an unlocking operation or a locking operation;

a support-connection portion formed on a rear side of the spring continuous control unit and directionally fixed to a lower end of a support plate with a preset width and extension length;

two hollow tubes spaced apart from each other and formed at an upper end of the support plate;

a connection tube formed at a rear side and a mass-center position of the backrest, wherein the two hollow tubes straddle the connection tube horizontally;

two hollow bodies introduced along the hollow tubes of the support plate, respectively, and positioned in the connection tube of the backrest;

a shaft penetrating the two hollow bodies and the connection tube of the backrest and directionally screwed to another end of the connection tube of the backrest with a screw nut, wherein the backrest is pivotally coupled to the support plate; and a torque spring inserted into inward sides of hollow bodies of the two hollow tubes of the support plate, wherein the torque spring has a pin abutting against a rear side of the backrest and another pin abutting against a rear side of the support plate to abut against the backrest;

wherein lifting the spring continuous control unit enables the spring continuous control unit to unlock and enter a free state and thereby enables the backrest adjustment mechanism to controllably drive the backrest to perform directional adjustment, wherein the backrest pivotally coupled to the support plate undergoes preset directional adjustment, wherein, pressing the spring continuous control unit allows the spring continuous control unit to return to a locked state and then precisely positions the backrest pivotally coupled to the support plate, wherein, alternatively, lifting the spring continuous control unit enables the spring continuous control unit to enter a free state in a manner that the backrest undergoes seamless displacement.

2. The backrest inclination structure for lumbar support of claim 1, wherein the backrest adjustment mechanism positioned at the chair laterally has front and rear covering plates corresponding in shape thereto and pressing against the support plate to cover a bottom and the two hollow tubes of the support plate directionally with upper and lower ends of the front and rear covering plates and to fix the front and rear covering plates to preset positions of the support plate with screwing elements.

3. The backrest inclination structure for lumbar support of claim 1, wherein the backrest adjustment mechanism positioned at the chair laterally has front and rear covering plates coupled to the support plate of the backrest, wherein through holes corresponding in position to the connection tube of the backrest and the two hollow tubes of the support plate are formed in the front covering plate to facilitate adjustment of movement between the support plate and the backrest, wherein a hollowed-out zone is formed at the rear covering plate to allow screwing elements to lock together the support plate and the support-connection portion on the spring continuous control unit when the lower end of the support plate is covered, or to facilitate subsequent removal of the screwing elements, wherein protruding portions spaced apart from each other protrude from the bottom of the rear covering plate and are inserted into apertures of the support plate, respectively, when an L-shape plate abuts against the hollowed-out zone.

* * * * *